US008465987B2

(12) United States Patent
Park et al.

(10) Patent No.: US 8,465,987 B2
(45) Date of Patent: Jun. 18, 2013

(54) APPARATUS, MICROFLUIDIC CHIP AND METHOD FOR SEPARATING PARTICLES USING ISOMAGNETOPHORESIS

(75) Inventors: Je-Kyun Park, Daejon (KR); Joo-Hun Kang, Seoul (KR); Sung-Young Choi, Gyeonggi-do (KR); Won-Hye Lee, Busan (KR)

(73) Assignee: Korea Advanced Institute of Science and Technology, Daejon (KR)

( * ) Notice: Subject to any disclaimer, the term of this patent is extended or adjusted under 35 U.S.C. 154(b) by 436 days.

(21) Appl. No.: 12/746,730

(22) PCT Filed: Nov. 19, 2008

(86) PCT No.: PCT/KR2008/006811

§ 371 (c)(1),
(2), (4) Date: Jun. 7, 2010

(87) PCT Pub. No.: WO2009/072763

PCT Pub. Date: Jun. 11, 2009

(65) Prior Publication Data

US 2010/0252436 A1 Oct. 7, 2010

(30) Foreign Application Priority Data

Dec. 7, 2007 (KR) ..... 10-2007-0126893

(51) Int. Cl.
*B03C 1/02* (2006.01)
*B03C 1/32* (2006.01)

(52) U.S. Cl.
USPC ..... 436/177; 422/502; 210/695

(58) Field of Classification Search
USPC ..... 210/695; 422/502
See application file for complete search history.

(56) References Cited

U.S. PATENT DOCUMENTS

| | | | | |
|---|---|---|---|---|
| 4,663,029 | A * | 5/1987 | Kelland et al. | 209/214 |
| 5,968,820 | A * | 10/1999 | Zborowski et al. | 435/325 |
| 2003/0044832 | A1 | 3/2003 | Blankenstein | |
| 2008/0124779 | A1 * | 5/2008 | Oh et al. | 435/173.9 |

FOREIGN PATENT DOCUMENTS

| | | |
|---|---|---|
| JP | 2007-209962 | 8/2007 |
| KR | 1020060094416 | 8/2006 |
| KR | 1020070082698 | 8/2007 |

OTHER PUBLICATIONS

Kang, Joo H. et al., "Isomagnetophoresis to Discriminate Subtle Difference in Magnetic Susceptibility," J. Am. Chem. Soc., vol. 130:396-397 (2008).

* cited by examiner

*Primary Examiner* — In Suk Bullock
*Assistant Examiner* — Paul Hyun
(74) *Attorney, Agent, or Firm* — Nelson Mullins Riley & Scarborough LLP; EuiHoon Lee, Esq.

(57) ABSTRACT

The present invention relates to a method of separating fine particles by measuring the magnetic susceptibilities thereof using isomagnetophoresis. In a system for separating fine particles using isomagnetophoresis according to the present invention, fluids having different magnetic susceptibilities and fine particles to be measured are introduced into a microfluidic channel to form a magnetic susceptibility gradient, a strong magnetic field is applied to the channel to control the behavior of the introduced fine particles, thus moving the fine particles to respective positions at which the fluids having magnetic susceptibilities identical to those thereof is present. According to the present invention, fine particles having a fine difference in magnetic susceptibility can be separated from each other by measuring the magnetic susceptibilities thereof.

9 Claims, 6 Drawing Sheets

(Prior art)

APPARATUS, MICROFLUIDIC CHIP AND METHOD FOR SEPARATING PARTICLES USING ISOMAGNETOPHORESIS

RELATED APPLICATIONS

This application is a 35 U.S.C. §371 national stage filing of PCT Application No. PCT/KR2008/006811 filed on Nov. 19, 2008, which claims priority to, and the benefit of, Korean Patent Application No. 10-2007-0126893 filed on Dec. 7, 2007. The contents of the aforementioned applications are hereby incorporated by reference.

TECHNICAL FIELD

The present invention relates to the separation and the measurement of magnetic susceptibility of biological cells and polymer particles, and more particularly to a system for continuously separating fine particles by using isomagnetophoresis to control the behavior of fine particles passing through a channel.

BACKGROUND ART

Biological information which is currently increasing is difficult to rapidly process using existing laboratory analysis systems. According to this tendency, biological detection systems for the elucidation of life phenomena, the development of new drugs and the diagnosis of diseases are, for purposes of analyzing samples in smaller amounts in a rapid and accurate manner for a short time based on microfluidics, being developed in the forms of micro-Total Analysis Systems (μ-TAS) and lab-on-a-chip. Because most biological samples to be analyzed are present in solution, technology for transferring liquid samples is considered a particularly important factor.

Microfluidics is a field of study in which the flow of microfluids is controlled and which studies and develops a key technology on which the commercial use of the micro-total analysis systems and lab-on-a-chips is based. The micro-total analysis system is a system in which chemical and biological experiments and assays comprising a number of experimental steps and reactions are comprehensively carried out in one unit present on one testing bench. Such a micro-total analysis system comprises a sample collection area, a microfluidic circuit, a detector and a controller for controlling them.

Also, the term "lab-on-a-chip" refers to a "laboratory-in-a-chip" or "laboratory-on-a-chip" technology. In this technology, microchannels of nanoliter or sub-nanoliter volumes are made using a material such as plastic, glass, silicon or the like, and liquid samples in amounts as small as a few nanoliters are moved through the microchannels, such that existing experiments or studies can be rapidly carried out. The realization of said micro-total analysis system or lab-on-a-chip capable of rapidly carrying out analysis for rapidly increasing biological information can be effectively achieved by effecting a combination with suitable methods for analyzing biological molecules.

Technology for separating particles using the magnetic susceptibility of particles is recently receiving a great deal of attention. The magnetic susceptibility of a material refers to the extent to which the material will become magnetized when placed in a magnetic field. Magnetic materials can be divided into diamagnetic materials, paramagnetic materials and ferromagnetic materials according to their magnetic susceptibility.

A prior magnetophoresis technique utilizes the phenomenon in which particles exposed to a magnetic field move simply by the force of the magnetic field. In the prior magnetophoresis technique, an insignificant difference in magnetic susceptibility between particles cannot be distinguished, and if there is a certain variation in the size of particles, the analytical errors will become larger, thus making it difficult to separate fine particles and analyze the magnetic properties thereof.

$$\overline{F}_{mag} = \frac{V(\chi_p - \chi_{surr})}{\mu_0} B(\nabla B) \qquad \text{[Math Figure 1]}$$

wherein V indicates the volume of particles, $\chi_p$ and $\chi_{surr}$ indicate the magnetic susceptibilities of particles and the surrounding fluid, respectively, B(∇B) represents a magnetic flux density gradient, and $\mu_0$ indicates the permeability in vacuum. According to the above equation, in the prior magnetophoresis technique, the parameter values are set according to the behavior of particles, and thus magnetophoretic particle separation has been used to separate magnetic particles showing a very great difference in size or magnetic susceptibility therebetween.

Korean Patent Registration No. 10-0695743 discloses a technique for separating biomolecular particles using magnetophoresis, which has a construction in which the behavior of a particle to which a magnetic field has been applied is continuously reinforced by the difference in magnetic susceptibility between it and the surrounding solution. However, this construction can be applied only to the case in which the difference in magnetic susceptibility between particles is great. In addition, because the volume of particles can change, there is difficulty in separating fine particles and analyzing the magnetic properties thereof.

FIG. 1 shows a prior system for separating fine particles using magnetophoresis. As shown in FIG. 1, the prior system for separating fine particles using magnetophoresis comprises an inlet 101 for introducing fine particles and a sample fluid, a microfluidic channel 102 through which the introduced fluid and fine particles pass, and a magnetic energy source 103 for applying a magnetic force in a direction perpendicular to the microfluidic channel 102. Herein, the moving pathway of the introduced fine particles is changed from the central portion of the channel by the magnetic force of the magnetic energy source 103, and the fine particles can be separated according to the degree of the pathway change. However, the fine particle-separating system can effectively separate fine particles only when the difference in magnetic susceptibility between the fine particles is great.

Also, technology for separating nanoparticles based on the difference in magnetic susceptibility between ferromagnetic nanoparticles and nanotubes has been studied (a research paper by Joo H. Kang and Je-Kyun Park; unpublished). This technology has a construction in which particles are separated from each other by observing the change in moving pathway of the particles caused by the difference in magnetic susceptibility between the particles. However, this technology can be applied only when the difference in magnetic susceptibility between particles is great.

Systems for separating fine particles using magnetic forces, which were developed to date, could be applied only when the volume of particles was large or the difference in magnetic susceptibility between particles was great. However, the industrial demand for the separation of fine particles, such as minerals, synthetic polymers, cells, proteins and nucleic acids, is increasing.

DISCLOSURE

Technical Problem

It is an object of the present invention to provide a system for separating fine particles which can measure the magnetic susceptibilities of fine particles (such as biomolecules, synthetic polymers, etc.) having a fine difference in magnetic susceptibility therebetween, using isomagnetophoresis, and, at the same time, can continuously separate such fine particles.

Another object of the present invention is to provide a microfluidic chip integrated so as to be able to separate fine particles using isomagnetophoresis.

Technical Solution

To achieve the above objects, in one aspect, the present invention provides a system for separating fine particles using isomagnetophoresis, which includes: inlets for introducing two or more fluids, having different magnetic susceptibilities, and specific fine particles; a microfluidic channel through which the introduced fluids and fine particles move; a magnetic energy source for applying a magnetic field in a direction perpendicular to the flow direction of the fine particles in the microfluidic channel; and an outlet for discharging the fine particles which passed through the microfluidic channel, wherein the fluids moving after being introduced flow with a magnetic susceptibility gradient in the microfluidic channel, the magnetic energy source forms a magnetic field in the microfluidic channel to magnetize the introduced fine particles, and the magnetized fine particles move to respective positions at which the fluids having magnetic susceptibilities identical to those thereof are present.

In another aspect, the present invention provides a microfluidic chip for separating fine particles using isomagnetophoresis, which includes: a polymer substrate having formed therein (a) inlet patterns for introducing fluids, having different magnetic susceptibilities and fine particles, (b) a microfluidic channel pattern through which the introduced fluids and fine particles move, and (c) an outlet pattern through which the fine particles, having passed through the microfluidic channel, are discharged through different pathways depending on their magnetic susceptibilities; a polymer thin film formed under the polymer substrate; a ferromagnetic microstructure formed under the polymer substrate, the ferromagnetic microstructure being provided laterally under the microfluidic channel; and a glass substrate provided under the polymer thin film and the ferromagnetic microstructure.

In still another aspect, the present invention provides a method for separating fine particles using isomagnetophoresis, which includes the steps of: (1) introducing fluids having different magnetic susceptibilities into a microfluidic channel to form a magnetic susceptibility gradient therein; (2) introducing fine particles to be measured into the microfluidic channel; (3) applying a magnetic field to the microfluidic channel in a direction perpendicular to the microfluidic channel so as to move the fine particles to respective positions in which the fluids having the same magnetic susceptibilities as those thereof are present; and (4) allowing the fine particles passed through the microfluidic channel to be discharged through different pathways depending on their magnetic susceptibilities.

Advantageous Effects

As described above, the inventive system and method for measuring the magnetic susceptibilities of fine particles can separate and analyze materials which could not be separated and analyzed by a prior magnetophoresis method.

Also, in the prior magnetophoresis method, there is great difficulty in separating and analyzing fine particles, because the magnetophoretic velocity of fine particles changes depending on the particle size due to the inherent characteristics of magnetophoresis; however, the isomagnetophoresis method according to the present invention can separate and analyze particles in a more reliable manner regardless of the particle size.

Furthermore, the inventive system for measuring the magnetic susceptibilities of fine particles can measure the magnetic susceptibilities of fine particles having a fine difference in magnetic susceptibility therebetween and can continuously separate fine particles using isomagnetophoresis.

In addition, the microfluidic chip of the present invention is easy to integrate and simple to carry.

Figure 1:
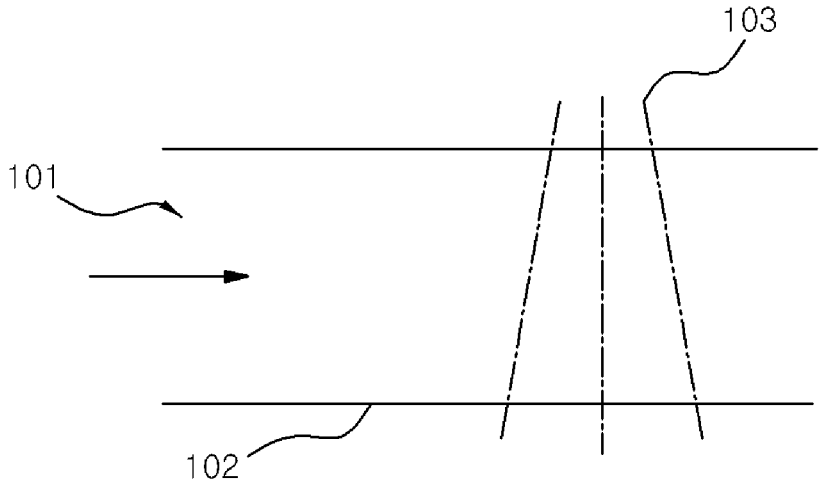
FIG. 1 schematically shows a magnetophoresis method according to the prior art.

<Description of important reference numerals used in the figures>

| | | | |
|---|---|---|---|
| 101: | inlet; | 102: | microfluidic channel; |
| 103: | magnetic energy source; | 201: | first fluid inlet; |
| 202: | second fluid inlet; | 203: | fine particle inlet; |
| 204: | intersection; | 205: | microfluidic channel; |
| 206: | outlet; | 207: | magnetic energy source; |
| 208: | ferromagnetic microstructure; | | |
| 209: | barriers; | | |
| 301: | ferromagnetic microstructure; | | |
| 302: | polymer substrate; | 303: | glass substrate; |
| 304: | polymer thin film; | | |
| 305: | cross-section of microfluidic channel. | | |

BEST MODE

A microfluidic chip for separating fine particles using isomagnetophoresis, which comprises: a polymer substrate having formed therein inlet patterns for introducing fluids, having different magnetic susceptibilities, and fine particles, a microfluidic channel pattern through which the introduced fluids and fine particles move, and an outlet pattern containing different pathways through which the fine particles passed through the microfluidic channel are discharged depending on their magnetic susceptibilities; a polymer thin film formed under the polymer substrate; a ferromagnetic microstructure formed under the polymer substrate, the ferromagnetic microstructure being provided laterally under the microfluidic channel; and a glass substrate provided under the polymer thin film and the ferromagnetic microstructure.

Hereinafter, a process will be described in which a system for measuring the magnetic susceptibilities of fine particles using isomagnetophoresis and continuously separating fine particles based on the measurement results is manufactured in the form of a microfluidic chip.

The microfluidic chip according to the present invention was manufactured in the following manner by a micromolding technique using poly(dimethylsiloxane) (PDMS).

Figure 3:
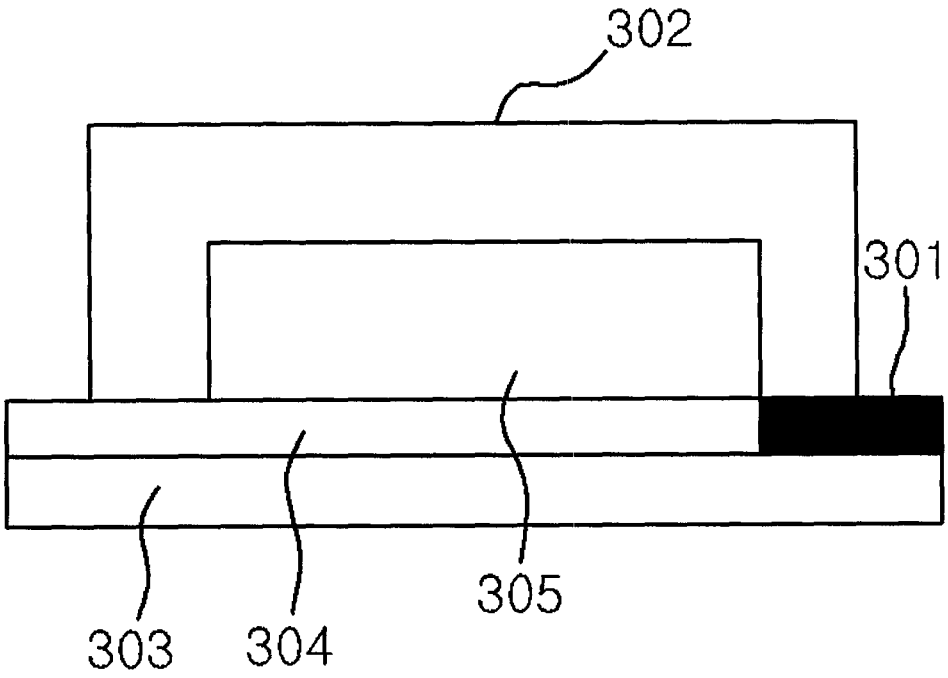
FIG. 3 is a cross-sectional view of the inventive microfluidic chip for measuring the magnetic susceptibility of fine particles using isomagnetophoresis and continuously separating fine particles based on the measurement results.

A microstructure mold having a width of 100 μm and a height of 20 μm was manufactured on a silicon wafer substrate by patterning using SU-8 as a photosensitive material. A 10:1 mixture of a PDMS prepolymer and a curing agent was poured into the manufactured mold and cured at 80° C. for 2 hours, thus manufacturing a PDMS substrate. After the curing process, holes were formed in the PDMS substrate, thus forming sample inlets and an outlet. Then, the PDMS substrate was oxidized with air plasma and deposited on a slide glass substrate together with a ferromagnetic microstructure, thus completing a microfluidic chip. FIG. 3 shows a cross-sectional view of the manufactured microfluidic chip.

Herein, the polymer substrate 302 is preferably made of at least one polymer selected from the group consisting of polydimethylsiloxane (PDMS), polymethylmethacrylate (PMMA), polyacrylate, polycarbonate, polycyclic olefin, polyimide and polyurethane.

The inventive method for separating fine particles using isomagnetophoresis comprises the steps of: (1) introducing two or more fluids having different magnetic susceptibilities into a microfluidic channel to form a magnetic susceptibility gradient therein; (2) introducing microparticles to be measured into the microfluidic channel; (3) applying a magnetic field to the microfluidic channel in a direction perpendicular to the microfluidic channel so as to move the fine particles to respective positions at which the fluids having magnetic susceptibilities identical to those thereof are present; and (4) allowing the fine particles passed through the microfluidic channel to be discharged through different pathways depending on their magnetic susceptibilities.

An experiment will now be described in which fluids having different magnetic susceptibilities are introduced into the isomagnetophoretic microfluidic chip using the above-described method and in which the isomagnetophoretic behavior of particles according to a magnetic susceptibility gradient formed in the microfluidic channel is analyzed.

In order to form a magnetic susceptibility gradient in fluids flowing in a microfluidic channel, the following experiment was carried out.

D-glucose and Gd-DTPA (gadolinium-diethylene-triaminepentaacetate) solutions having different magnetic susceptibilities were prepared and introduced into the above-manufactured isomagnetophoretic microfluidic chip, and fluids containing microparticles were introduced into the microfluidic chip. In this Example, 15-μm microparticles consisting of polystyrene (PS), polymethyl methacrylate (PMMA) and borosilicate (BS), respectively, were used. The PS and PMMA microparticles are materials which are difficult to separate and analyze using prior magnetophoresis techniques, because they have similar magnetic susceptibilities.

When a permanent magnet is used to form a magnetic flux density gradient in the flow of the fine particles which are flowing aligned to the central portion of the channel by the introduced fluids, the fine particles feel a magnetic force which is proportional to the difference between their magnetic susceptibilities and that of the surrounding fluid. After magnetophoretic movement to a point at which the magnetic susceptibilities of the particles are the same as those of the fluids containing particles, the particles no longer feel a magnetic force, and thus the particles flow with the fluids without undergoing magnetophoresis and move to the outlet.

MODE FOR INVENTION

Figure 2:
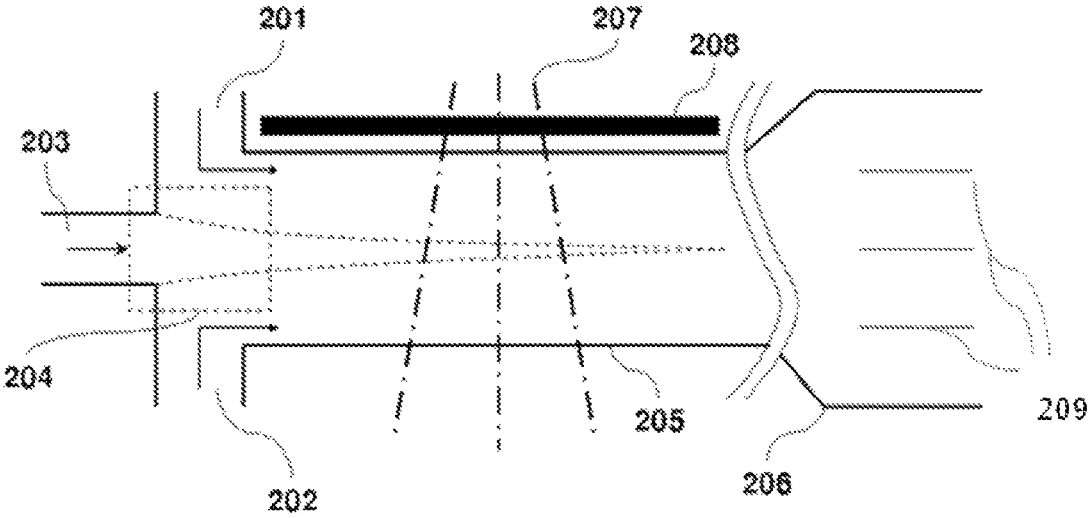
FIG. 2 shows the structure of the inventive system for measuring the magnetic susceptibility of magnetic particles using isomagnetophoresis and continuously separating fine particles based on the measurement results.

FIG. 2 shows the inventive system for measuring the magnetic susceptibility of fine particles and separating fine particles using isomagnetophoresis. The inventive system for measuring the magnetic susceptibility of fine particles and separating fine particles comprises the first fluid inlet 201 for introducing a fluid having a relatively high magnetic susceptibility, the second fluid inlet 202 for introducing a fluid having a relatively low magnetic susceptibility, a fine particle inlet 203, an intersecting portion 204, a microfluidic channel 205, an outlet 206, a magnetic energy source 207 and a ferromagnetic microstructure 208.

The present invention is characterized in that two or more fluids having different magnetic susceptibilities are introduced through different inlets. As shown in FIG. 2, a fluid having high magnetic susceptibility is introduced from left, and a fluid having low magnetic susceptibility is introduced from right. The introduced fluids having different magnetic susceptibilities flow in a state aligned to the central line 205 or specific region of the microfluidic channel 205.

The position to which the fluids are aligned can be controlled by applying the same or different pressures from the upper and lower directions. In addition, a given fluid control device for controlling the fluid flows may also be used.

The fine particles to be measured are introduced through the fine particle inlet 203 formed between the first fluid inlet 201 and the second fluid inlet 202 and meet at the intersection 204.

In this case, the system can be constructed such that the fluids and the fine particles can be simultaneously introduced and pass through the microfluidic channel 205.

The microfluidic channel 205 which is a conduit for passing the introduced sample fluids and fine particles to the outlet 206 is formed of a kind of polymer substrate.

In the microfluidic channel 205, the fluids having different magnetic susceptibilities form a magnetic susceptibility gradient by diffusion, and the fine particles are magnetized by the magnetic energy source 207 which applies a magnetic field in a perpendicular direction, and move to respective positions at which the fluids having magnetic susceptibilities identical to those thereof are present.

Then, the fine particles move with the fluids to the outlet 206.

The magnetic energy source 207 forms a magnetic flux density gradient in the microfluidic channel 205 and applies a magnetic force to the fine particles. For example, the magnetic energy source 207 may be an electromagnet or a permanent magnet.

In order to increase the magnetic flux density gradient, which is applied by the magnetic energy source 207, the system of the present invention may further comprise a ferromagnetic microstructure 208. Namely, the ferromagnetic microstructure 208 functions to form an enhanced magnetic flux density gradient throughout the microfluidic channel to apply a magnetic force to the fine particles.

The ferromagnetic microstructure 208 is formed in the lengthwise direction of the microfluidic channel.

For this purpose, the ferromagnetic microstructure 208 is made of a material such as nickel and may consist of repeated protrusions.

As materials for forming the ferromagnetic microstructure, ferromagnetic materials, such as nickel, iron and cobalt, and ferromagnetic alloys, such as permalloy (a nickel alloy containing 20-25% iron) and superpermalloy, may be used.

The repeated protrusions of the ferromagnetic microstructure function to repeatedly produce portions of strong magnetic flux density gradient on the microfluidic channel to increase the magnetophoretic velocity and force of the fine particles present in the channel.

The fine particles introduced into the microfluidic channel 205 are influenced by the magnetic flux density gradient created by the magnetic energy source 207 and the ferromagnetic microstructure 208.

The fine particles receive a magnetic force which is proportional to the difference between their magnetic susceptibility and that of the surrounding fluids. Thus, the fine particles which have moved in the channel by magnetophoresis stop at positions at which the fluids having magnetic susceptibilities identical to those thereof are present, and the fine particles flow with the fluids.

Such an isomagnetophoresis phenomenon is explained by the Math Figure described above. In Math FIG. 1, when a magnetic susceptibility gradient is formed across the microfluidic channel ($\chi_{surr}$) the particles move by magnetophoresis created by the difference between their magnetic susceptibility and that of the surrounding fluids, and then no longer feel a magnetic force at a point at which the magnetic susceptibilities of the particles are the same as those of the fluids (isopoint, $\chi_p-\chi_{surr}=0$). Accordingly, positions to which the particles are aligned also change depending on their magnetic susceptibilities, and thus particles having a fine difference in magnetic susceptibilities can also be continuously separated from each other. Then, the fine particles flow with the fluids to the outlet 206.

The outlet 206 is a region for capturing the fine particles separated through the microfluidic channel 205 and has a width wider than that of the microfluidic channel 205. Namely, the outlet 206 has a branched structure formed by one or more barriers 209 at the end of the microfluidic channel 205, such that it can capture the fine particles separated by isomagnetophoresis.

Due to the branched structure of the outlet 206, the fine particles having different magnetic susceptibilities are separated from each other.

The inventive microfluidic chip in which the system for measuring the magnetic susceptibility of fine particles and separating fine particles from each other is integrated will now be described with reference to FIG. 3. Referring to FIG. 3, the microfluidic chip of the present invention comprises a polymer substrate 302 for measuring the magnetic susceptibility of fine particles and continuously separating fine particles using isomagnetophoresis, and a glass substrate 303 constituting the bottom of the microfluidic channel.

Between the polymer substrate 302 and the glass substrate 303, a polymer thin film 304 and a ferromagnetic microstructure 301 are formed.

In the polymer substrate 302, two or more fluid inlet patterns for introducing fluids and fine particle inlet patterns for introducing fine particles may further be formed.

The polymer thin film 304 forms the bottom of the microfluidic channel.

The ferromagnetic microstructure 301 is formed at the lower outside of the microfluidic channel 305 in the lengthwise direction of the microfluidic channel.

The polymer substrate 302 can be manufactured by a conventional method such as patterning and micromolding.

The ferromagnetic microstructure 301 can be manufactured by a conventional method such as electroplating.

Figure 6:
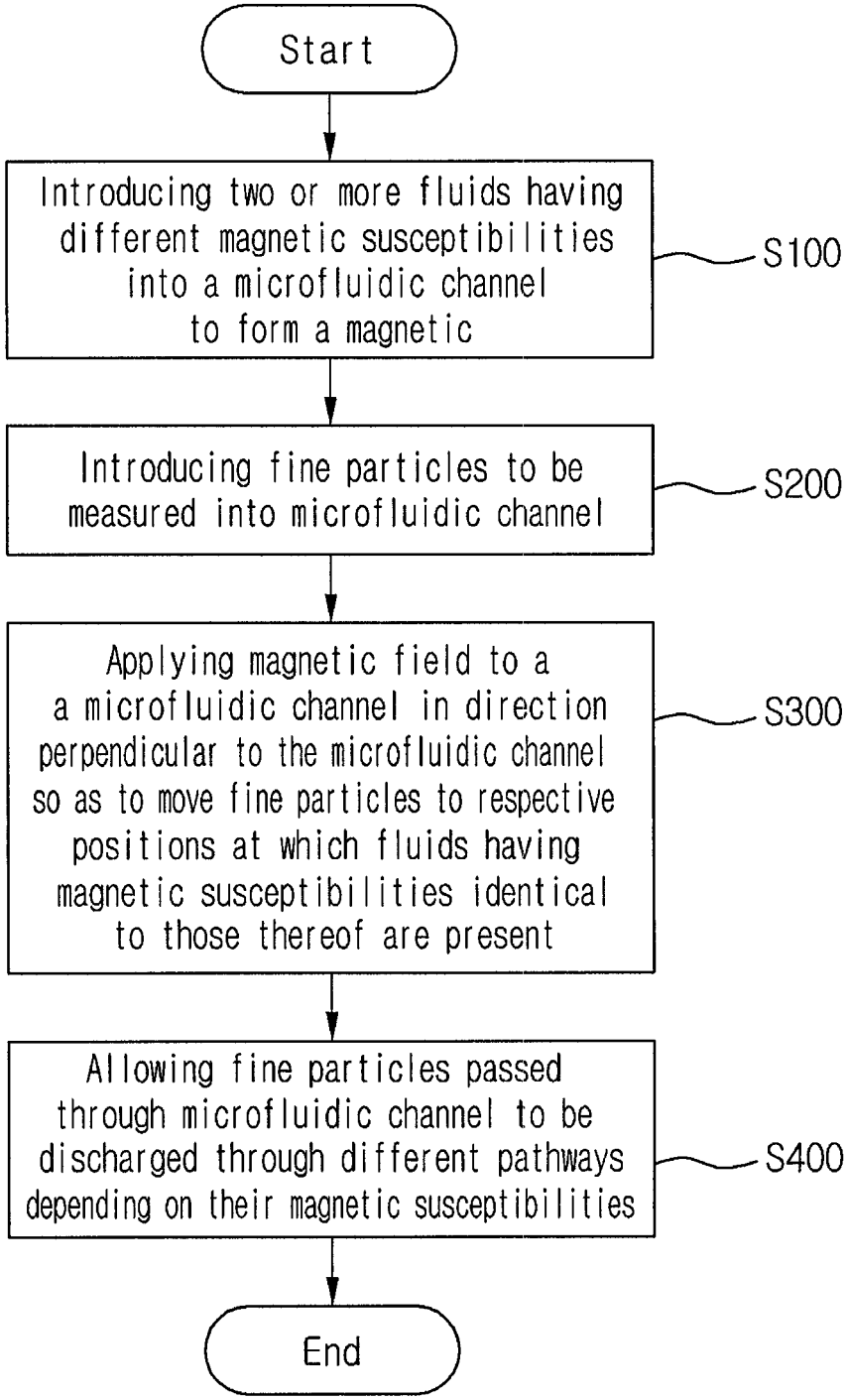
FIG. 6 is a flowchart showing a method for separating fine particles using isomagnetophoresis according to the present invention.

Hereinafter, the operation of the inventive system for measuring magnetic susceptibility and separating fine particles will be described with reference to FIGS. 2 and 6.

First, fluids having different magnetic susceptibilities are introduced into a microfluidic channel to form a magnetic susceptibility gradient therein (S100).

The fluids are introduced from right and from left into the microfluidic channel 205 and move along the central line or specific area of the channel depending on the pressure at which the fluids are introduced into the channel.

Then, the introduced fluids are diffused in the microfluidic channel according to their diffusion coefficients to form a magnetic susceptibility gradient.

Then, fine particles to be measured are introduced into the microfluidic channel (S200). In another embodiment of the present invention, the fluids and the fine particles may be simultaneously introduced.

The introduced fine particles combine with the sample fluids at the intersection 204 and flow together with the sample fluids in a state aligned to the central portion or specific portion of the channel.

The fine particles which have flowed along the channel move along a magnetic flux density gradient, amplified by the ferromagnetic microstructure 208, to respective positions in which the fluids having magnetic susceptibilities identical to those thereof are present (S300). Namely, the movement of the fine particles which have moved by a magnetic force resulting from the difference between their magnetic susceptibility and that of the surrounding fluids stops at a point at which the difference in magnetic susceptibility disappears, and then the fine particles flow with the fluids.

The fine particles which have flowed with the fluids pass through the microfluidic channel and are discharged and captured by the outlet having branches formed at the end of the microfluidic channel (S400).

Hereinafter, the present invention will be described in further detail with reference to examples. It is to be understood, however, that these examples are for illustrative purposes only and are not intended to limit the scope of the present invention.

First, a process will be described in which a system for measuring the magnetic susceptibilities of fine particles using isomagnetophoresis and continuously separating fine particles based on the measurement results is manufactured in the form of a microfluidic chip.

The microfluidic chip according to the present invention was manufactured by a micromolding technique using poly (dimethylsiloxane) (PDMS).

A microstructure mold having a width of 100 μm and a height of 20 μm was manufactured on a silicon wafer substrate by patterning using SU-8 as a photosensitive material. A 10:1 mixture of a PDMS prepolymer and a curing agent was poured into the manufactured mold and cured at 80° C. for 2 hours, thus forming a PDMS substrate. After the curing process, holes were formed in the PDMS substrate to form sample inlets and an outlet. Then, the PDMS substrate was oxidized with air plasma and deposited on a slide glass substrate together with a ferromagnetic microstructure, thus completing a microfluidic chip. A cross-sectional view of the manufactured microfluidic chip is shown in FIG. 3.

Herein, the polymer material used for manufacturing the polymer substrate 302 is preferably polydimethylsiloxane (PDMS), polymethylmethacrylate (PMMA), polyacrylate, polycarbonate, polycyclic olefin, polyimide, polyurethane or the like.

Hereinafter, an experiment will be described in which fluids having different magnetic susceptibilities are introduced into the isomagnetophoretic microfluidic chip using the above-described method and in which the isomagnetophoretic behavior of particles according to a magnetic susceptibility gradient formed in the microfluidic channel is analyzed.

In order to form a magnetic susceptibility gradient in fluids flowing in the microfluidic channel, the following experiment was carried out.

D-glucose and Gd-DTPA (gadolinium-diethylene-triaminepentaacetate) solutions having different magnetic susceptibilities were prepared and introduced into the above-manufactured microfluidic chip, and fluids containing fine particles were introduced into the microfluidic chip. In this Example, 15-μm-diameter microparticles consisting of polystyrene (PS), polymethyl methacrylate (PMMA) and borosilicate (BS), respectively, were used as the fine particles. The PS and PMMA microparticles are difficult to separate and analyze by prior magnetophoresis techniques, because they have similar magnetic susceptibilities.

When a permanent magnet is used to form a magnetic flux density gradient in the flow of the fine particles which are flowing aligned to the central portion of the channel by the introduced fluids, the fine particles receive a magnetic force which is proportional to the difference in their magnetic susceptibility and that of the surrounding fluids. After magnetophoretic movement to a point at which the magnetic susceptibility of the particles is the same as that of the fluids containing particles, the particles can no longer feel a magnetic force, and thus the particles flow with the fluids without undergoing magnetophoresis and move to the outlet.

Meanwhile, for comparison with a prior magnetophoresis technique, when Gd-DTPA is introduced into the two inlets 201 and 202 (FIG. 2) and the polymer microparticles are introduced into the fine particle inlet 203, the results of the prior magnetophoresis method can be obtained. The results obtained by the prior magnetophoresis method and the results of separation and analysis of microparticles by the isomagnetophoresis method of the present invention are shown in FIGS. 4 and 5, respectively.

Figure 4:
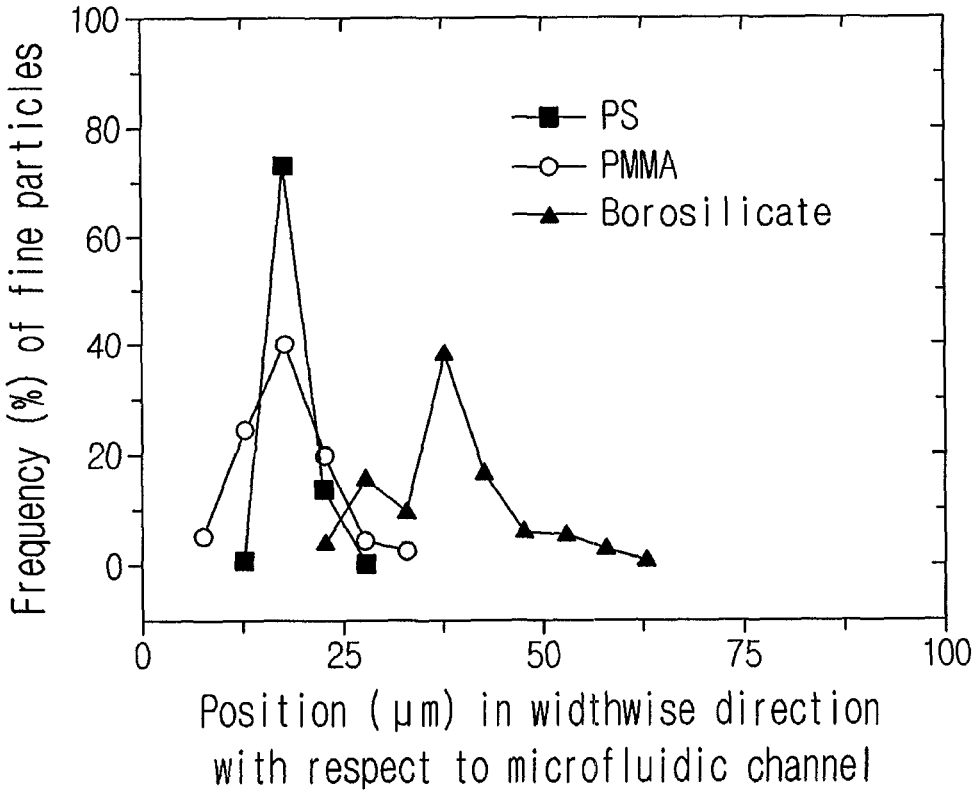
FIG. 4 is a graphic diagram showing analysis of the results obtained by separating fine particles using a prior magnetophoresis method.
Figure 5:
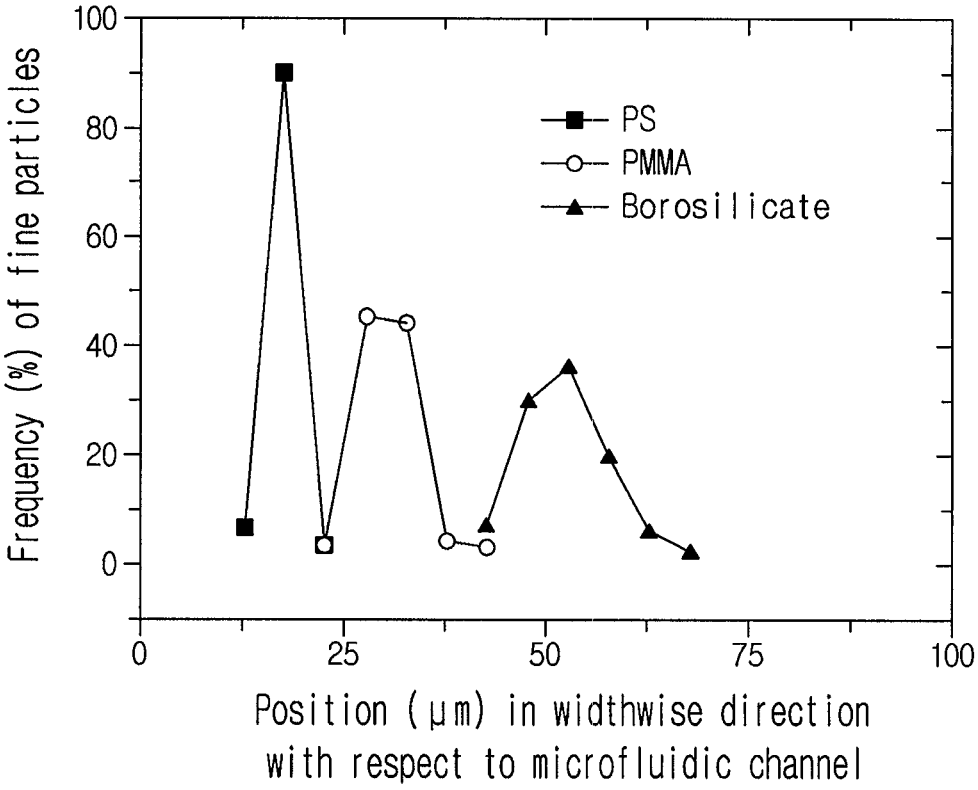
FIG. 5 is a graphic diagram showing analysis of the results obtained by separating fine particles using the inventive isomagnetophoresis method for measuring the magnetic susceptibilities of fine particles and continuously separating fine particles based on the measurement results.

As shown in FIGS. 4 and 5, it can be seen that the PS microparticles and the PMMA microparticles were not separated from each other by the prior magnetophoresis method, but a fine difference in magnetic susceptibility between the microparticles could be distinguished by the inventive isomagnetophoresis method carried out in the fluids having a Thus, when the isomagnetophoresis method of the present invention is used, materials which could not be separated and analyzed by the prior magnetophoresis method can be analyzed and can be continuously separated using the inventive system for separating fine particles.

INDUSTRIAL APPLICABILITY

As described above, according to the present invention, fine particles can be separated from each other, even when the particles have a small volume or there is a small difference in magnetic susceptibility therebetween. Thus, the present invention is useful for separating fine particles, such as minerals, synthetic polymers, cells and nucleic acids, in the medical and bioengineering fields.

The invention claimed is:

1. A method for separating fine particles using isomagnetophoresis, which comprises the steps of:

(1) introducing two or more fluids having different magnetic susceptibilities from each other into a microfluidic channel to form a magnetic susceptibility gradient therein, wherein each of said two or more fluids is introduced through respective inlets and each of said two or more fluids comprises no fine particles;

(2) introducing fine particles to be measured into the microfluidic channel through an inlet different from said respective inlets for said two or more fluids;

(3) applying a magnetic field to the microfluidic channel in a direction perpendicular to the microfluidic channel so as to move the fine particles to respective positions at which fluids having the same magnetic susceptibilities as those thereof are present; and (4) allowing the fine particles which have passed through the microfluidic channel to be discharged through different pathways depending on their magnetic susceptibilities, wherein the method is implemented by using a system comprising:

inlets for introducing said two or more fluids, having different magnetic susceptibilities, and specific fine particles;

a microfluidic channel through which the introduced fluids and fine particles move;

a magnetic energy source for applying a magnetic field in a direction perpendicular to the flow direction of the fine particles in the microfluidic channel;

a ferromagnetic microstructure for amplifying a magnetic flux density gradient applied by the magnetic energy source; and an outlet for discharging the fine particles which have passed through the microfluidic channel, wherein the fluids moving after being introduced flow with a magnetic susceptibility gradient in the microfluidic channel, the magnetic energy source forms a magnetic field in the microfluidic channel to magnetize the introduced fine particles, and the magnetized fine particles move to respective positions at which the fluids having magnetic susceptibilities identical to those thereof are present.

2. The method of claim 1, wherein the fluids which are introduced in step (1) and the fine particles which are introduced in step (2) are simultaneously introduced into the microfluidic channel.

3. The method of claim 1, wherein the fluids which are introduced in step (1) are aligned depending on the magnetic susceptibility gradient in the microfluidic channel and flow in the aligned state.

4. The method of claim 1, wherein the inlets include:

two or more fluid inlets formed at the side of the microfluidic channel, such that the fluids are introduced through the side of the microfluidic channel; and a fine particle inlet formed between the two or more fluid inlets so as to introduce the fine particles therethrough.

5. The method of claim 1, wherein the magnetic energy source consists of an electromagnet or a permanent magnet.

6. The method of claim 1, wherein the ferromagnetic microstructure consists of repeated protrusions.

7. The method of claim 1, wherein the ferromagnetic microstructure is formed at the outside of one side of the microfluidic channel in the lengthwise direction of the microfluidic channel.

8. The method of claim 1, wherein:

the inlets, the microfluidic channel and the outlet are formed as patterns in a polymer substrate;

the outlet pattern contains different pathways through which the fine particles, having passed through the microfluidic channel, are discharged depending on their magnetic susceptibilities;

a polymer thin film is formed under the polymer substrate;

the ferromagnetic microstructure is formed under the polymer substrate, the ferromagnetic microstructure being provided laterally under the microfluidic channel; and a glass substrate provided under the polymer thin film and the ferromagnetic microstructure.

9. The method of claim 8, wherein the polymer substrate is made of at least one polymer selected from the group consisting of polydimethylsiloxane (PDMS), polymethylmethacrylate (PMMA), polyacrylate, polycarbonate, polycyclic olefin, polyimide and polyurethane.

* * * * *